United States Patent [19]

King et al.

[11] Patent Number: 4,946,335

[45] Date of Patent: Aug. 7, 1990

[54] SUCTION LIFTING DEVICE

[75] Inventors: James F. King; Brodie T. Winborne, both of Winston-Salem, N.C.

[73] Assignee: Winborne Company, Ltd., Winston-Salem, N.C.

[21] Appl. No.: 234,123

[22] Filed: Aug. 17, 1988

[51] Int. Cl.[5] ..... E01C 5/00; E01C 19/00

[52] U.S. Cl. ..... 414/736; 294/63.1; 294/65; 294/81.6; 414/737

[58] Field of Search ..... 414/736, 737, 744.8, 414/752; 294/65, 65.5, 63.1, 87.1, 81.6

[56] References Cited

U.S. PATENT DOCUMENTS 3,506,140 4/1970 Koch et al. ..... 414/737 X 4,787,812 11/1988 Gopfert ..... 294/65 X

*Primary Examiner*—Robert J. Spar

*Assistant Examiner*—Donald W. Underwood

[57] ABSTRACT

A suction lifting device for lifting and laying a layered plurality of individual slabs, bricks, stones and the like in unison to provide an exterior paved surface of a road, walk, roof or the like. A plurality of vacuum pucks are supported by the vacuum plenum of a frame through flexible tubular members which operably engage a similar number of slabs or bricks and move them in unison to a preselected and configured location. The frame is carried by a supporting means and a load-bearing member which can be mounted on a self-propelled apparatus.

30 Claims, 2 Drawing Sheets

SUCTION LIFTING DEVICE

FIELD OF INVENTION

This invention relates generally to suction lifters and more particularly to a suction lifting device capable of lifting a layer of individual bricks, slabs and the like in unison.

BACKGROUND, OBJECTIVES, SUMMARY AND FIGURE DESCRIPTION

Suction lifting devices have been used for a considerable period of time in association with mobile lifting and conveying devices. See, for example, the disclosure of U.S. Pat. No. 2,899,089. Such devices have been primarily used to lift and transport heavy loads, usually large single items such as sheets of glass, pipe, packages and the like.

More recently, it has become a common practice to pave parking lots, walks, parks and even building roofs with particularly designed concrete slabs or bricks since these provide great durability and functionality as well as unique and attractive appearances. Generally such slabs or bricks must be normally and individually laid so that proper spacing between them is maintained. One way to machine lay individual bricks or slabs is shown in my co-pending U.S. patent application Ser. No. 07/234,117 entitled VACUUM LIFTING DEVICE; however, there are few devices available that are suitable for lifting and laying a plurality of slabs or bricks in layered form at one time. Each slab or brick can weigh up to 10 pounds or more and therefore in the aggregate represent a sizeable load if a layer is to be lifted and placed in one operation.

Bricks or slabs often utilized in the activity described are usually manufactured in batches of about 40 bricks using a grid resembling a plurality of egg crates or cookie cutters placed in a side-by-side relationship. The grid is made of thin steel and is constructed to extend slightly above the finished brick. The grid, which is open on both sides, is placed on a flat surface and filled with concrete. A hydraulic ram with as many brick shapes as there are openings in the grid is brought down in registry with the grid, and the concrete is compacted to eliminate voids. The grid is then lifted relative to the ram and the formed bricks are pressed out on a curing sheet to dry and cure. After the concrete is set, the group of bricks is deposited, one layer upon another, until about 10 layers are built up on a pallet for shipment to the job site.

There have been several attempts to provide a lifting and transporting mechanism to handle layers of bricks or slabs. One device is provided with a clamp that extends down along the sides of a layer of bricks and exerts horizontal pressure against the brick sides to bind the bricks together and permit the layer which can weigh approximately 400 pounds to be moved and placed without dropping the load. A number of disadvantages are associated with this technique. First the clamp jaws have to extend at least to the mid point of the brick height. If the brick layer is aligned on two sides to brick already laid, the layers are separated from the other laid layers by the thickness of the edge of the clamp. Secondly, when the device carrying the clamp is lowered to allow the clamped bricks to align with previously laid bricks, there is only about 1 inch of brick exposed below the clamped jaws. From a practical standpoint this is not enough height since the equipment does not allow for minute adjustment, and the operator's vision is impaired by the clamping means extending beyond the brick edges. Additionally, the clamping force necessary to support the bricks is great and the bricks are pressed together as much as possible. When they are brought into alignment with laid bricks that have been allowed to relax and separate, they will not fit tightly into the openings of the relaxed bricks already laid. A discernible and undesirable open joint is left.

Another system utilized a vacuum to lift a layer of bricks in unison. In that system, a rectangular plenum supports a plurality of tubular sleeves each of which extends downwardly to engage a brick of the layer to be lifted. Each rigid vacuum connection has a short, contractable corrugated tube connected to it. The other end of the tube is connected to the puck that contacts a brick. These collapsible tubes are as large in diameter as the brick shape will allow so that when suction on the brick is established, the corrugated tube will maintain its diameter but will shorten. While this system seems to work effectively, it is very expensive to construct and does not provide a finite adjustment feature that allows a laid layer of brick to relax naturally and blend in with adjacent previously laid layers.

The primary objective of the present invention is to provide a device that will lift a layer of bricks formed as described from a pallet and deposit the layer in a preselected location and configuration on the prepared site.

Another objective of the present invention is to provide a suction lifting device of the type described that is relatively inexpensive to build, easy to operate, and capable of some discrete adjustments to allow the individual bricks within a lifted layer to move slightly with respect to each other to thus become relaxed and to thereby blend in with adjacent laid layers without leaving a noticeable open joint therebetween.

The present invention comprises a supporting means, a load bearing member and a frame having a vacuum plenum associated with it. The frame is supported by the load bearing member and can be operably positioned in predetermined locations by an operator. A plurality of vacuum pucks are supported by the frame and vacuum plenum through a plurality of flexible tubular members connecting each of the pucks to the plenum. A puck alignment plate engages the tubular members and moves from the pucks toward the frame and back again as a layer of bricks are engaged, lifted and transported to the location where it is to be laid. A vacuum source is connected to the device through an appropriate vacuum line. Most often, the device is mounted on a self-propelled lifting and conveying apparatus such as a forklift truck.

The objectives set forth above and other objectives will become more apparent after a consideration of the following detailed description taken in conjunction with the accompanying drawings wherein like characters of reference designate like parts throughout the several views.

FIGS. 3(*a*) through (*e*) illustrates several different configurations of self-propelled lifting and conveying devices embodying the present invention.

Figure 4:
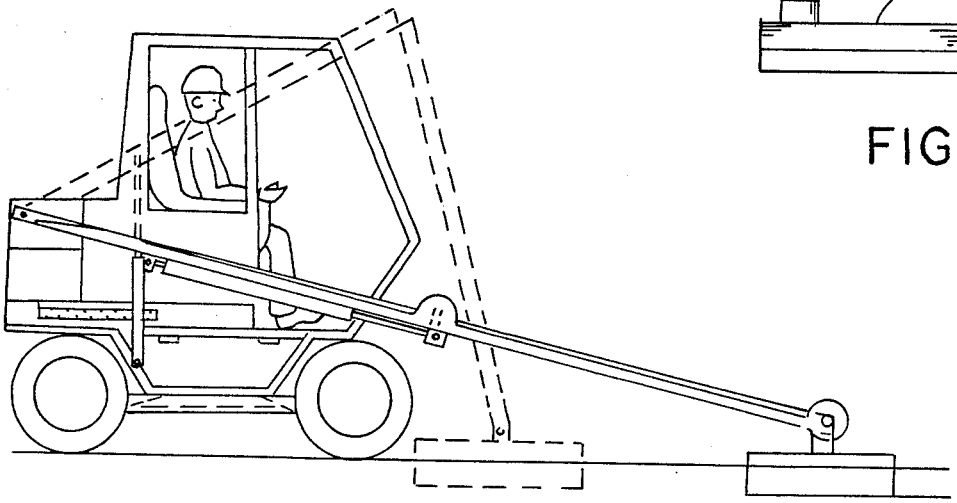

FIG. 4 is a side elevational view of a mobile lifting and conveying apparatus embodying the present invention illustrating the positioning of a layer of bricks from one location to another.

Figure 5:
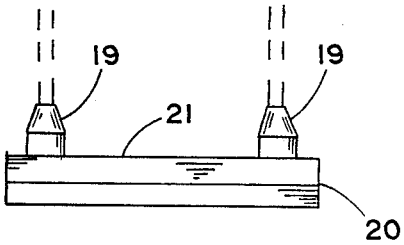

FIG. 5 is a side elevational view of a puck and its two connected flexible tubular members to which is secured an alignment plate guide collar.

DETAILED DESCRIPTION OF THE INVENTION

Figure 1:
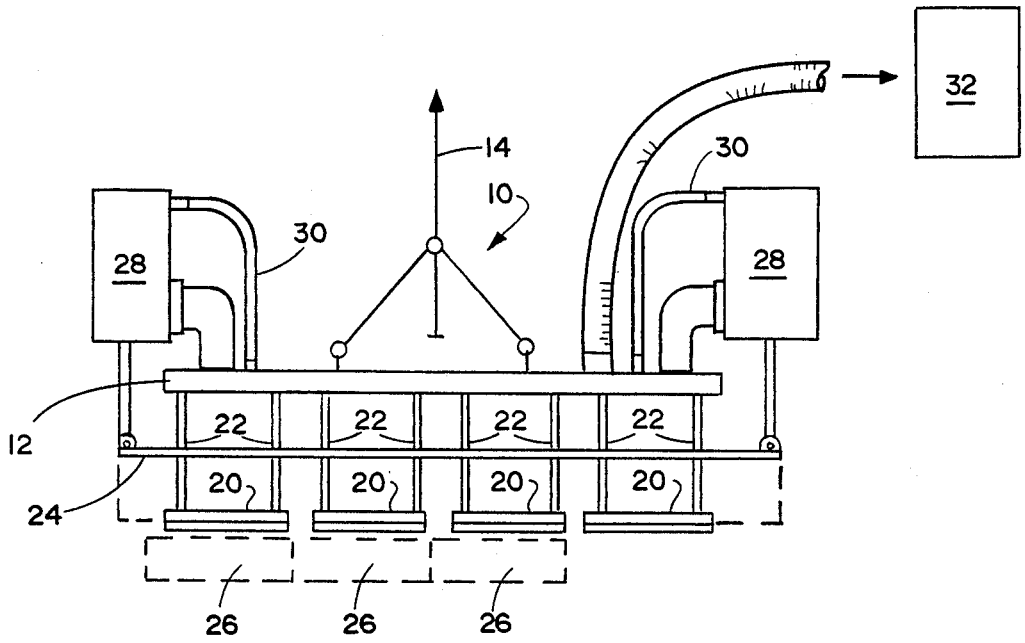
FIG. 1 is a side elevational schematic view of the frame of the present invention showing the vacuum plenum, vacuum pucks and connecting tubular members carried thereby.
Figure 2:
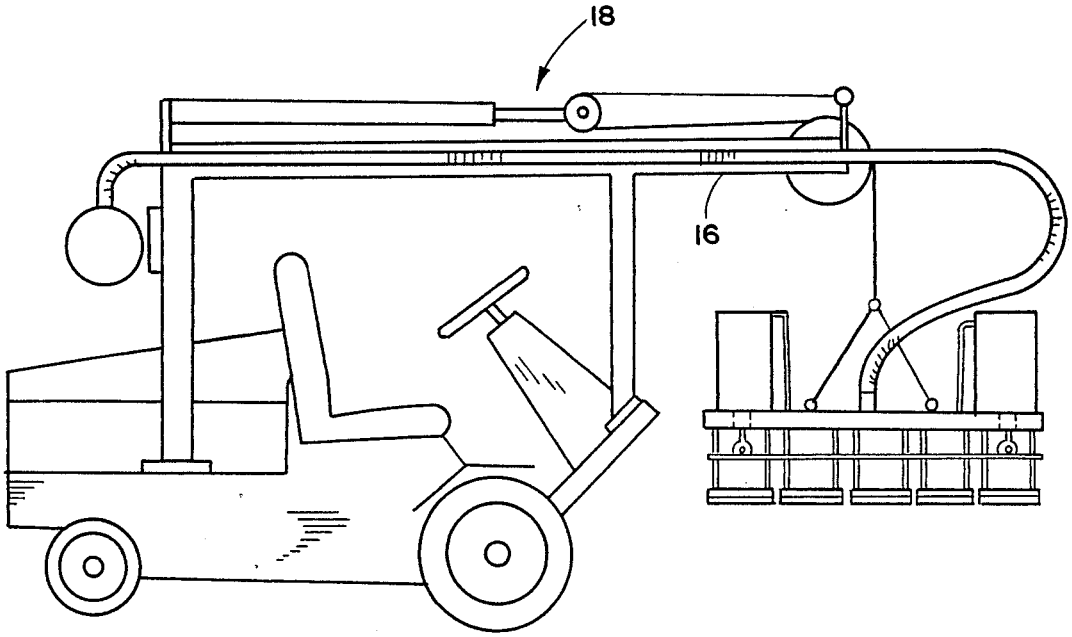
FIG. 2 is a side elevational view of a mobile suction lifting device embodying the present invention wherein the frame of FIG. 1 is adjustably supported and carried by a self-propelled lifting and conveying apparatus.
Figure 3A:
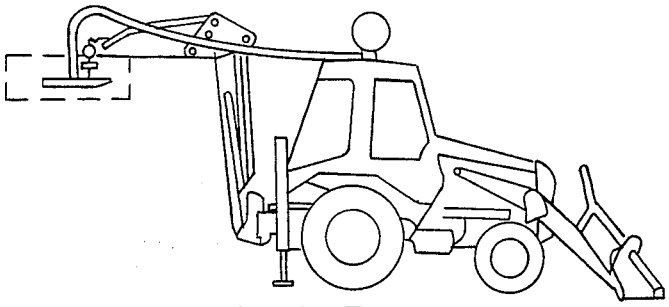
Figure 3D:
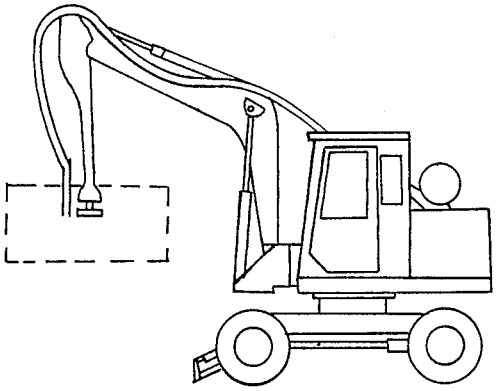
Figure 3B:
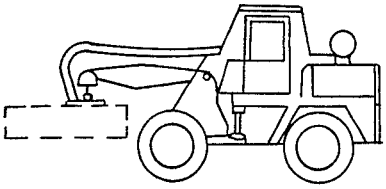
Figure 3E:
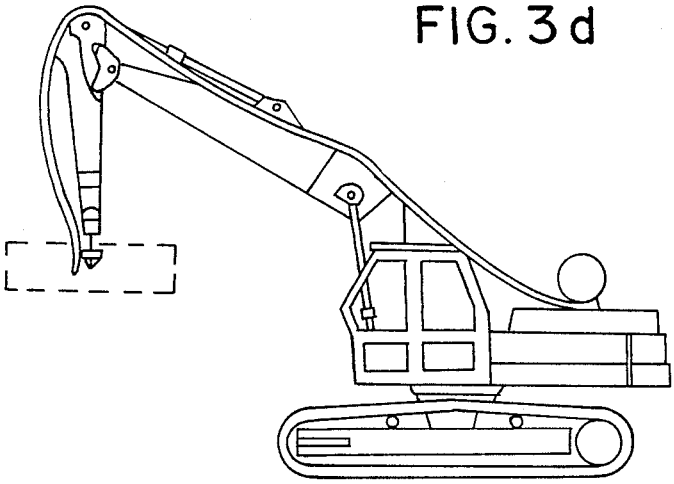
Figure 3C:
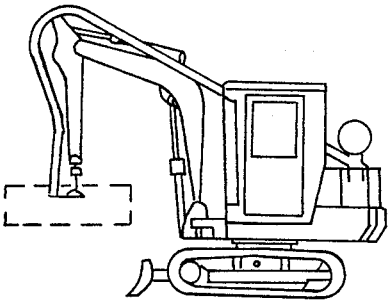

Referring now to the drawings and particularly to FIG. 1, the frame shown generally as 10 of the present invention contains a vacuum plenum 12 and other apparatus to be described all of which are suspended from a cable 14 connected to a load bearing member such as the boom 16 shown in FIG. 2. A suitable pulley arrangement shown generally as 18 can be utilized to raise and lower frame 10 as desired. Boom 16 can be selectively moved horizontally.

A plurality of vacuum pucks 20 are supported beneath vacuum plenum 12 by flexible tubes 22. Each puck 20 is carried by two of these small diameter and very flexible tubes 22 that do not change in shape when a vacuum is applied. Each puck 20 is heavy enough to cause its connected tubes 22 to hang substantially vertical beneath plenum 12.

A perforated alignment plate 24 is movably installed between vacuum plenum 12 and pucks 20 having holes therein in alignment with the flexible tubes 22 so that the alignment plate 24 can move vertically from directly under the plenum 12 to a lower position resting on top of pucks 20 and back again. When alignment plate 24 is lowered, flexible tubes 22 which fit in the holes of plate 24 guide the pucks 20 to a predetermined position. The flat surface of plate 24 resting on the flat surface of pucks 20 causes the seal of pucks 20 to flatten out for contact with their respective bricks 26. After frame 10 has been lowered onto the brick layer and the vacuum applied to cause the pucks 20 to engage bricks 26, the alignment plate 24 is power lifted up the flexible tubes 22 to rest directly under the plenum 12. Thus a single brick 26 hangs from a single puck 20 and is supported by two flexible tubes 22 so that bricks 26 are allowed to swing freely and align with each other.

When the lifted, free swinging bricks 26 are moved into position to be deposited against two sides of previously laid layers of bricks, a slight controlled movement of the load bearing beam 16 encourages each brick to individually align with adjacent bricks before the bricks are lowered into their final position and the vacuum is deactivated to release then from pucks 20.

To ensure the exact positioning of each brick within a layer with respect to its adjacent bricks, it has been found helpful to utilize alignment plate guide collars 19, one of which will loosely encircle a flexible tube 22 or, alternatively, be secured to the top surface 21 of puck 20. These guide collars 19 positively direct the alignment plate 24 in the precise position required as the plate is moved downwardly along tubular members 22 and eventually contacts the tops 21 of pucks 20.

Each puck 20 has a vacuum seal (not shown) affixed to its lower surface which is made of a rubber-like material or of closed cell foam. An improved seal for suction lifting devices suitable for use with the present invention is the subject matter of my co-pending application Ser. No. 07/234,346.

A plurality of air cylinders 28 are supported by frame 10 in the manner shown in FIG. 1 and operate to selectively displace alignment plate 24. Vacuum lines 30 connect cylinders 28 to vacuum plenum 12 for operation.

The present invention is most often used in association with a self-propelled apparatus which carries the support base and load bearing member in various and convenient ways. See, for example, the embodiments shown in FIGS. 3(*a*) through (*e*). The flexibility of the device in association with such apparatus is clearly illustrated in FIG. 4 where layers of brick are positioned forwardly or to either side.

A novel apparatus constitutes the present invention which uses small diameter and flexible tubes that support the weight of the puck 20 and the brick 26 directly associated. Two tubes 22 are used with each puck 20 with the tube separation being as great as the puck dimension will allow. The vacuum plenum 12 above the pucks 20 holds the tubes in precise positions to align with the tube connections in the pucks 20. The alignment plate 24 is movably positioned between the plenum 12 and the pucks 20 and aligned with flexible tubes 22 to permit the plate 24 to move up and down and allow the pucks 20 to swing freely when plate 24 is against plenum 12 and to position and level each puck 20 when plate 24 is positioned against the pucks. Power means such as four hydraulic or pneumatic cylinders 28 (one at each corner) raise and lower alignment plate 24 with respect to pucks 20. In practice, the four vacuum operated cylinders 28 are connected to the lifting vacuum source 32 so that when no bricks 26 are engaged, the multiple inlet tubes 30 reduce the effective vacuum in the system and the weight of alignment plate 24 drops it to its lowest position against pucks 20. When the assembly is lowered onto a layer of bricks, air admitted to the system is blocked by the puck seals, vacuum in the system builds to a maximum, and the four vacuum cylinder automatically lift alignment plate 24 to its maximum elevation adjacent the vacuum plenum 12.

Whereas one example of the invention has been described with reference to the drawings in connection with a variety of self propelling devices, other variations as will occur to those skilled in the art are contemplated and are all deemed to within the scope of the appended claims.

We claim:

1. A suction lifting device comprising:

a supporting means; a load bearing member carried by said supporting means; a frame having a vacuum plenum attached thereto; means movably connecting said frame to said load bearing member; a plurality of vacuum pucks adjacent said frame; a plurality of flexible tubular members connecting each of said vacuum pucks to said vacuum plenum; a puck alignment plate engaging said tubular members; means associated with said alignment plate to move said plate with respect to said frame and said pucks; seal means affixed at each of said pucks; a vacuum source; and means connecting said vacuum source to said vacuum plenum.

2. The device as claimed in claim 1 further including a self-propelled apparatus carrying said supporting means and said load-bearing member.

3. The device as claimed in claim 1 wherein said connecting means is flexible.

4. The device as claimed in claim 1 wherein said alignment plate moves from a position contiguous with said pucks to a position away therefrom and toward said frame.

5. The claim as claimed in claim 1 wherein said plate moving means is cylinder means.

6. The device as claimed in claim 1 wherein said seal means is a seal made of rubber-like material.

7. The device as claimed in claim 1 wherein said vacuum source connecting means is an air hose.

8. The device as claimed in claim 5 wherein said cylinder means is a plurality of air cylinders.

9. The device as claimed in claim 6 wherein said seal is made of closed cell foam.

10. The device as claimed in claim 8 wherein said air cylinders have an air hose extending to said vacuum plenum and a rod connector engaging said alignment plate.

11. The device as claimed in claim 3 wherein said alignment plate moves from a position contiguous with said pucks to a position away therefrom and toward said frame.

12. The device as claimed in claim 11 wherein said plate moving means is cylinder means.

13. The device as claimed in claim 12 wherein said sealing means is a seal made of rubber-like material.

14. The device as claimed in claim 13 wherein said vacuum source connecting means is an air hose.

15. The device as claimed in claim 14 wherein said cylinder means is a plurality of air cylinders.

16. The device as claimed in claim 15 wherein said seal is made of closed cell foam.

17. The device as claimed in claim 16 wherein said air cylinders have an air hose extending to said vacuum plenum and a rod connector engaging said alignment plate.

18. The device as claimed in claim 2 wherein said connecting means is a cable.

19. The device as claimed in claim 18 wherein said alignment plate moves from a position contiguous with said pucks to a position away therefrom and toward said frame.

20. The device as claimed in claim 19 wherein said plate moving means is cylinder means.

21. The device as claimed in claim 20 wherein said sealing means is a seal made of rubber-like material.

22. The device as claimed in claim 21 wherein said vacuum source connecting means is an air hose.

23. The device as claimed in claim 22 wherein said cylinder means is a plurality of air cylinders.

24. The device as claimed in claim 23 wherein said seal is made of closed cell foam.

25. The device as claimed in claim 24 wherein said air cylinders have an air hose extending to said vacuum plenum and a rod connector engaging said alignment plate.

26. A suction lifting device for lifting arrays of objects such as concrete brick and the like comprising: a support base; a load bearing member carried by said support base; a frame having a vacuum plenum attached thereto; a retractable and flexible connecting means connecting said frame and plenum to said load bearing member; a plurality of vacuum pucks positioned adjacent same frame and plenum and planarly parallel thereto; two flexible tubular members engaging each of said vacuum pucks and said vacuum plenum; a puck alignment plate engaging said flexible tubular members; a plurality of air cylinders carried by said frame each having a vacuum hose extending to said vacuum plenum and a connecting rod operably connected to said alignment plate to move said plate from a position contiguous with said pucks to a position near said frame and back again; a seal carried by the bottom surface of each of said pucks within which a vacuum is formed to engage the load to be lifted; a vacuum source; and an air hose operable extending from said vacuum source to said vacuum plenum.

27. The device as claimed in claim 26 further including a self-propelled apparatus carrying said suppor base and said load bearing member.

28. The device as claimed in claim 3 wherein an alignment collar encircles each tubular member adjacent its connected puck for engagement by said alignment plate when it is moved adjacent said pucks.

29. The device as claimed in claim 20 wherein an alignment collar encircles each tubular member adjacent its connected puck for engagement by said alignment plate when it is moved adjacent said pucks.

30. The device as claimed in claim 27 wherein an alignment collar encircles each tubular member adjacent its connected puck for engagement by said alignment plate when it is moved adjacent said pucks.

* * * * *